US009038993B2

(12) United States Patent
Forslund

(10) Patent No.: US 9,038,993 B2
(45) Date of Patent: May 26, 2015

(54) DESUPERHEATER WITH FLOW MEASUREMENT

(71) Applicant: Control Components, Inc., Rancho Santa Margarita, CA (US)

(72) Inventor: Tord Forslund, Saffle (SE)

(73) Assignee: Control Components, Inc., Rancho Santa Margarita, CA (US)

( * ) Notice: Subject to any disclaimer, the term of this patent is extended or adjusted under 35 U.S.C. 154(b) by 156 days.

(21) Appl. No.: 13/914,427

(22) Filed: Jun. 10, 2013

(65) Prior Publication Data

US 2014/0151908 A1 Jun. 5, 2014

Related U.S. Application Data

(60) Provisional application No. 61/733,333, filed on Dec. 4, 2012.

(51) Int. Cl.
*F22G 5/12* (2006.01)
*B01F 3/04* (2006.01)

(52) U.S. Cl.
CPC *F22G 5/123* (2013.01); *F22G 5/12* (2013.01); *B01F 3/04014* (2013.01); *B01F 3/04049* (2013.01)

(58) Field of Classification Search
CPC .... B01F 3/04; B01F 3/04014; B01F 3/04021; B01F 3/04049; F22G 5/12; F22G 5/123
USPC ..... 261/115, 118, 127, 128, 129, 159, 160, 261/DIG. 13
See application file for complete search history.

(56) References Cited

U.S. PATENT DOCUMENTS

| | | | | |
|---|---|---|---|---|
| 2,421,761 | A | 6/1947 | Rowand et al. | |
| 3,134,357 | A | 5/1964 | Halle | |
| 3,244,898 | A | 4/1966 | Hickox | |
| 4,880,447 | A * | 11/1989 | Bloch | 95/225 |
| 4,909,445 | A | 3/1990 | Schoonover | |
| 5,439,619 | A | 8/1995 | Kuffer | |
| 6,276,823 | B1 * | 8/2001 | King | 366/181.5 |
| 2011/0298141 | A1 | 12/2011 | Ristau et al. | |

FOREIGN PATENT DOCUMENTS

JP 2003329212 A * 11/2003

OTHER PUBLICATIONS

Patent Cooperation Treaty, International Search Report and Written Opinion, Apr. 23, 2014.

* cited by examiner

*Primary Examiner* — Robert A Hopkins
(74) *Attorney, Agent, or Firm* — Stetina Brunda Garred & Brucker

(57) ABSTRACT

In accordance with the present invention, there is provided a steam desuperheater which is integrated into a steam line. The steam desuperheater comprises a segment of steam pipe having one or more spring loaded spray nozzles attached thereto. Installed within the interior of the steam pipe of the desuperheater is a liner. The desuperheater is also provided with a steam flow measurement sub-assembly comprising a differential pressure transmitter including a pair of pressure gauges which are operatively connected to respective ones of a first pressure tapping which is formed in the steam pipe before the liner, and a second pressure tapping which is formed in the liner. The measurement of the differential pressure allows for a determination of steam flow through the desuperheater. In addition to the differential pressure transmitter outfitted onto the steam pipe, the steam flow measurement sub-assembly further preferably comprises pressure and temperature transmitters which are installed in the steam line upstream of the desuperheater for providing a density determination that is also required for the steam flow determination.

8 Claims, 4 Drawing Sheets

DESUPERHEATER WITH FLOW MEASUREMENT

CROSS-REFERENCE TO RELATED APPLICATIONS

The present application claims priority to U.S. Provisional Patent Application Ser. No. 61/733,333 entitled Desuperheater With Flow Measurement filed Dec. 4, 2012.

STATEMENT RE: FEDERALLY SPONSORED RESEARCH/DEVELOPMENT

Not Applicable

BACKGROUND OF THE INVENTION

1. Field of the Invention

The present invention pertains generally to steam desuperheaters and, more particularly, to a steam desuperheater which it outfitted with a differential pressure transmitter operative to provide a measurement of steam flow through the desuperheater.

2. Description of the Related Art

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional amounts of superheat.

A steam desuperheater can lower the temperature of superheated steam by spraying cooling water into the flow of superheated steam passing through a steam pipe. Once the cooling water is sprayed into the flow of superheated steam, the cooling water mixes with the superheated steam and evaporates, drawing thermal energy from the steam and lowering its temperature. In this regard, currently known steam desuperheaters typically comprise a segment of steam pipe which is integrated into a steam line. The steam pipe of the desuperheater has one or more water atomizing nozzles attached thereto. The nozzles are connected to a common spray water pipe connection. The spray water flow is controlled by a separate spray water control valve. In certain desuperheaters, a liner is installed in the steam pipe to improve the system turndown or to protect the steam line.

However, one of the deficiencies associated with currently known steam desuperheaters is the absence of any modality outfitted thereon which is adapted to provide a measurement of steam flow therethrough. The present invention addresses this deficiency by providing a steam desuperheater which is outfitted with a differential pressure transmitter operative to provide a measurement of steam flow through the desuperheater. These, as well as other features and advantages of the present invention, will be described in more detail below.

BRIEF SUMMARY OF THE INVENTION

In accordance with the present invention, there is provided a steam desuperheater which is integrated into a steam line. The steam desuperheater comprises a segment of steam pipe having one or more spring loaded spray nozzles attached thereto. The nozzles are connected to a common spray water pipe connection, with the flow of water being controlled by a separate spray water valve. In this regard, the nozzles, the spray water pipe connection, and the spray water valve are components of a spray water sub-assembly of the desuperheater. Installed within the interior of the steam pipe of the desuperheater is a liner which is adapted to optimize the performance of the desuperheater. In this regard, the liner acts like a nozzle as makes it suitable for use in relation to the steam flow measurement principles of the present invention.

The desuperheater of the present invention is also provided with a steam flow measurement sub-assembly. This steam flow measurement sub-assembly comprises a differential pressure transmitter including a pair of pressure gauges which are operatively connected to respective ones of a first pressure tapping which is formed in the steam pipe before the liner, and a second pressure tapping which is formed in the liner. In the present invention, the measurement of the differential pressure allows for a determination of steam flow through the desuperheater. In addition to the differential pressure transmitter outfitted onto the steam pipe of the desuperheater, the steam flow measurement sub-assembly further preferably comprises pressure and temperature transmitters which are installed in the steam line upstream of the desuperheater for providing a density determination that is also required for the steam flow determination.

Those of ordinary skill in the art will recognize that the pressure gauges and associated pressure tappings of the steam flow measurement sub-assembly may be provided as original components of the desuperheater operatively interfaced to the steam pipe and liner thereof, or alternatively may be provided as part of a stand-alone steam flow measurement system which is adapted to be retrofitted to an existing desuperheater. Irrespective of whether the pressure gauges and associated pressure tappings are provided as original components or are adapted for retrofit application, those of ordinary skill in the art will further recognize that the upstream pressure and temperature transmitters of the steam flow measurement sub-assembly or stand-alone steam flow measurement system will be retrofit to the existing steam line proximate the steam pipe of the desuperheater integrated therein.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
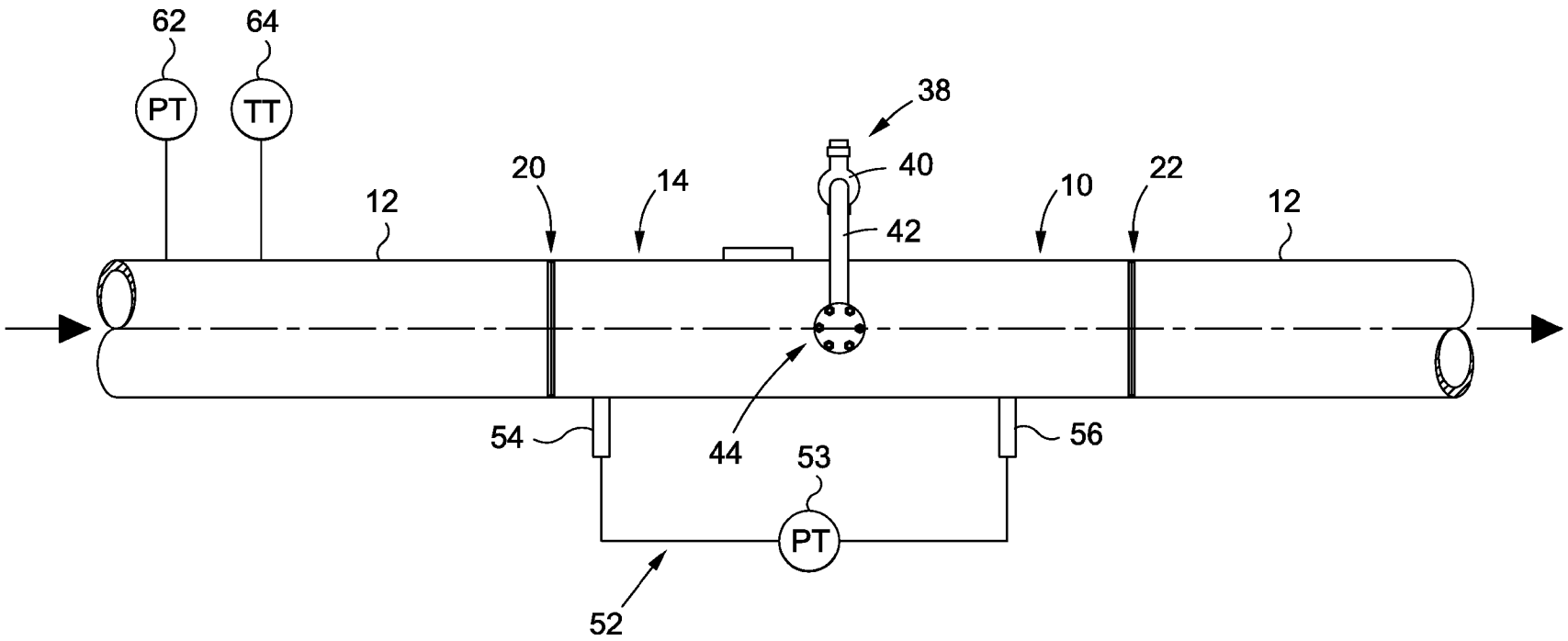
FIG. 1 is a side elevational view of an exemplary steam line having a steam desuperheater and a steam flow measurement system constructed in accordance with the present invention integrated therein.
Figure 2:
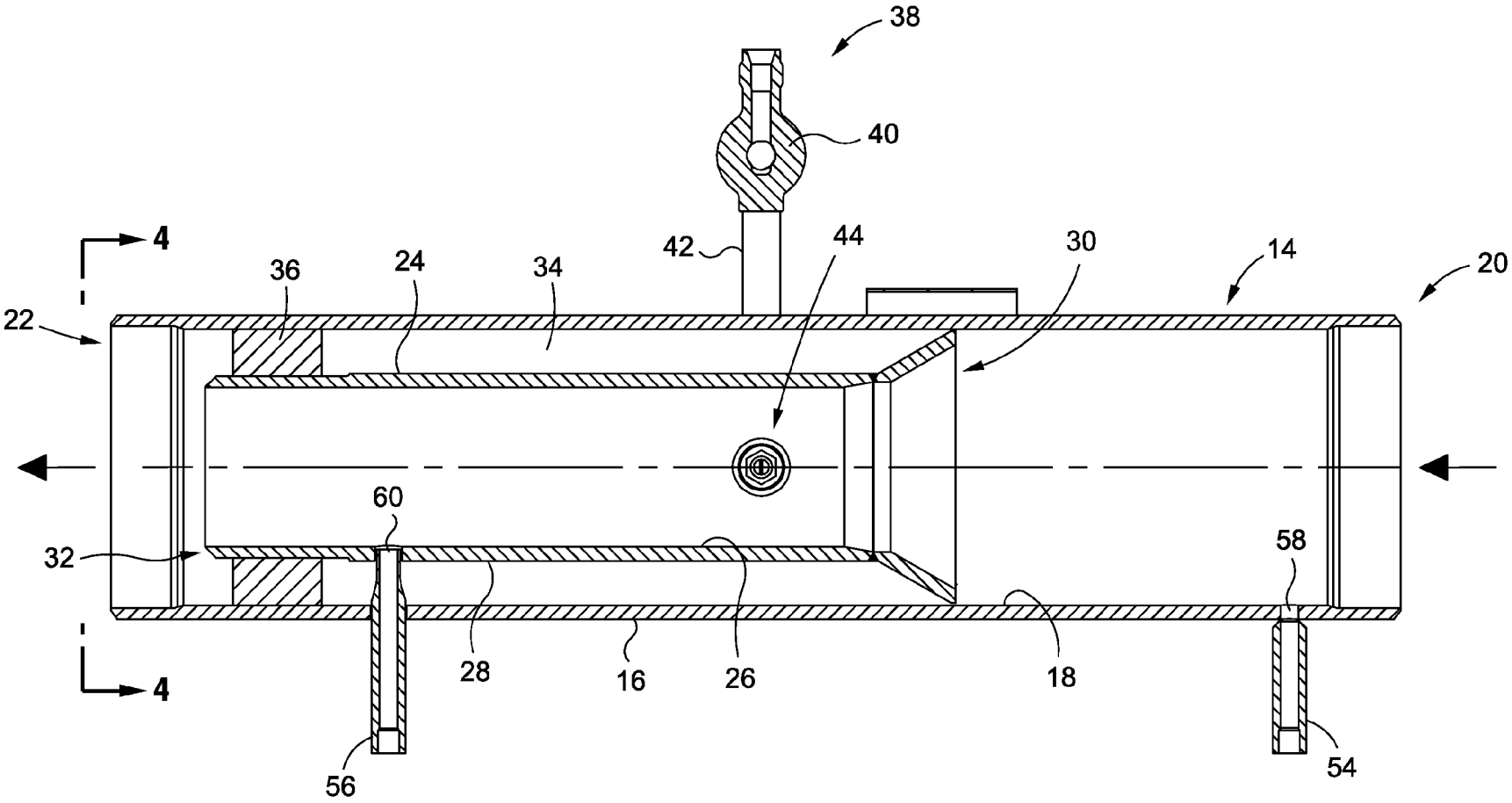
FIG. 2 is a cross-sectional view of the desuperheater shown in FIG. 1, illustrating the liner integrated into the steam pipe of the desuperheater and the pressure gauges of the steam flow measurement system as operatively connected to the steam pipe and the liner.
Figure 4:
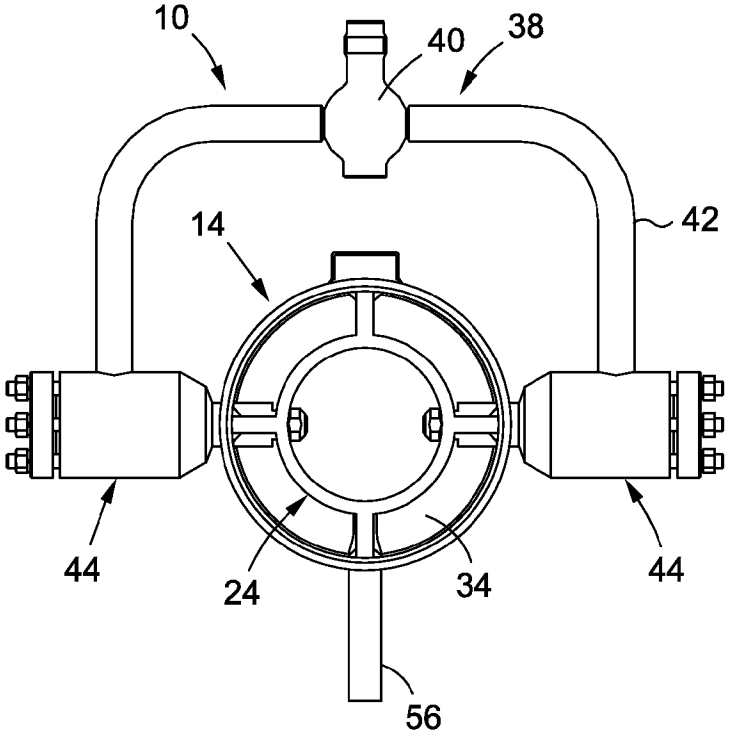
FIG. 4 is an end view of the desuperheater taken along line 4-4 of FIG. 2.
Figure 3:
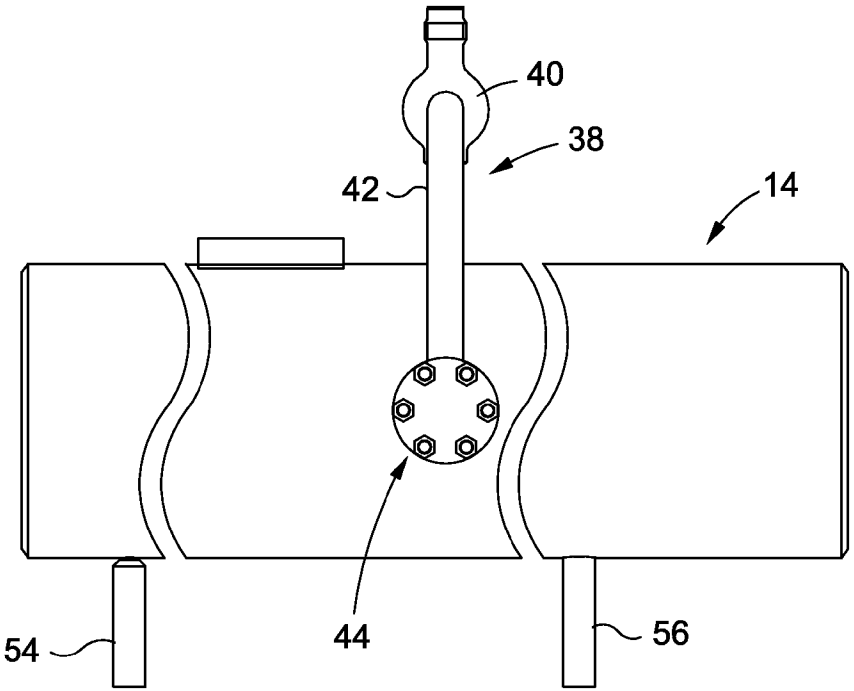
FIG. 3 is an enlargement of a portion of the desuperheater shown in FIG. 1.
Figure 5:
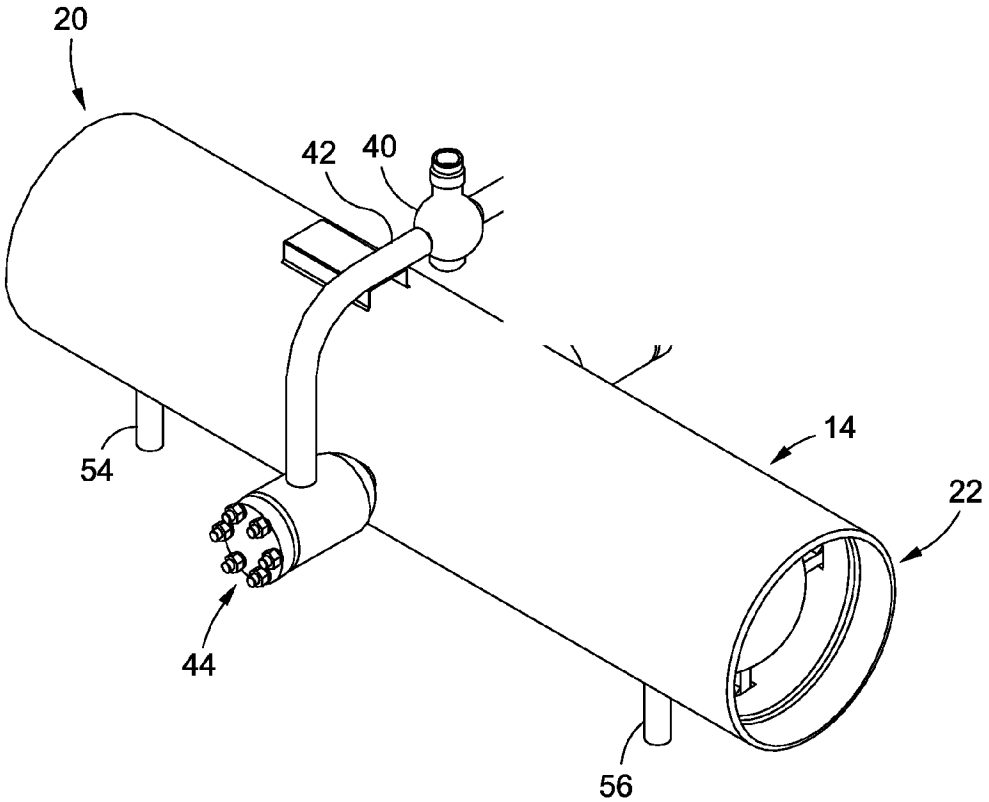
FIG. 5 is a perspective view of the desuperheater shown in FIG. 2.

Referring now to the drawings wherein the showings are for purposes of illustrating a preferred embodiment of the present invention only, and not for purposes of limiting the same, FIG. 1 depicts a steam desuperheater 10 as integrated into an existing steam line 12. The desuperheater 10, as separated from the steam line 12, is shown in FIGS. 2, 4 and 5. When integrated into the steam line 12, the direction of steam flow through the desuperheater 10 is designated by the arrows shown in FIGS. 1 and 2.

The desuperheater 10 comprises a tubular segment of steam pipe 14 which has a generally circular, cross-sectional configuration. The steam pipe 14 is of a prescribed length, and defines an outer surface 16 and an inner surface 18 (which itself defines a pipe conduit). In addition, the steam pipe 14 defines an inlet end 20 and an outlet end 22.

In addition to the steam pipe 14, the desuperheater 10 comprises a tubular liner 24 which is disposed (i.e., concentrically positioned) within the interior of the steam pipe 14, and itself has a generally circular cross-sectional configuration. As is best seen in FIG. 2, like the steam pipe 14, the liner 24 is of a prescribed length, and defines an inner surface 26 (which itself defines a liner conduit) and an outer surface 28. The liner 24 also defines an outwardly flared inlet end 30, and an opposed outlet end 32. The distal rim defined by the outwardly flared inlet end 30 preferably abuts the inner surface 18 of the steam pipe 14. However, other than for such distal rim defined by the inlet end 30, the remainder of the outer surface 28 of the liner 24 is disposed in spaced relation to the inner surface 18 of the steam pipe 14. In this regard, as is also seen in FIG. 2, the majority of the length of the outer surface 28 of the liner 24 is spaced from the inner surface 18 of the steam pipe 14 by an annular gap 34. To maintain its prescribed concentric positioning within the interior of the steam pipe 14, the liner 24 is preferably outfitted with a support ring 36 which fills the gap 34 between portions of the outer and inner surfaces 28, 18, and is located proximate the outlet end 32. As will be recognized, based on the direction of steam flow designated by the arrows shown in FIG. 2, the flared inlet end 30 of the liner 24 prevents steam flow into the gap 34, and instead facilitates the channeling of such flow into the remainder of the liner 24, the inner diameter of which is less than that of the steam pipe 14 as indicated above. A more comprehensive discussion of desuperheater liners such as the liner 24 is included in Applicant's U.S. Patent Publication No. 2009/0065295 (entitled Desuperheater Muffler), the disclosure of which is incorporated herein by reference.

Figure 6:
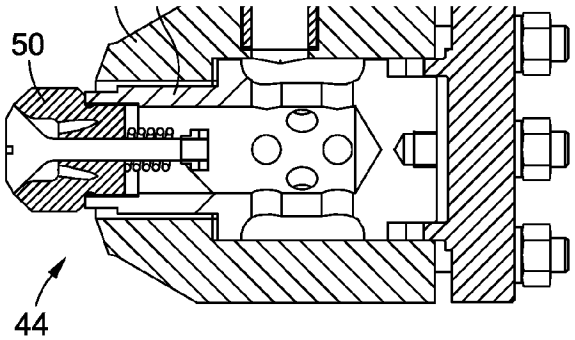
FIG. 6 is a cross-sectional view of an exemplary spray nozzle which may be integrated into a spray water sub-assembly of the desuperheater.

The desuperheater 10 further comprises a spray water sub-assembly 38 which is operatively connected to the steam pipe, as well as the liner 24 within the steam pipe 14. The spray nozzle sub-assembly 38 comprises a control valve 40 which is fluidly connected to a cooling water feed line (not shown). Fluidly connected to the control valve 40 is a spray water pipe 42 which, as most apparent from FIG. 4, is segregated into an identically configured pair of segments which extend from the control valve 40 in opposed relation to each other. Fluidly connected to those ends of the spray water pipe 42 opposite those directly attached to the control valve 40 are respective ones of an identically configured pair of spring-loaded spray nozzle assemblies 44 of the spray-water sub assembly 38, one of which is shown with particularity in FIG. 6.

As further seen in FIG. 4, a portion of each spray nozzle assembly 44 extends through the steam pipe 14, gap 34 and liner 24 into the interior of the liner 24, with those portions of the spray nozzle assemblies 44 protruding into the interior or liner conduit of the liner 24 being diametrically opposed to each other (i.e., separated by an interval of approximately) 180°. Within the spray water sub-assembly 38, the control valve 40 regulates the flow of cooling water into the spray water pipe 42, typically in response to a signal from a temperature sensor mounted in the interior of the steam line 12 downstream of the spray nozzle assemblies 44. The pressurization of the spray nozzle assemblies 44 resulting from the opening of the control valve 40 facilitates the movement of the spray nozzle assemblies 44 from a closed position to which they are normally biased to an open position, thus providing a spray of cooling water into the interior of the liner 24 in order to reduce the temperature of superheated steam flowing therethrough as a result of evaporation of the cooling spray water within the steam flow. Though, FIG. 4 depicts a diametrically opposed pair of spray nozzle assemblies 44 mounted to the steam pipe 14 and extending into the interior of the liner 24 in the aforementioned manner, those of ordinary skill in the art will recognize that greater or fewer than two spray nozzle assemblies 44 may be included in the spray water sub-assembly 38 in differing arrangements without departing from the spirit and scope of the present invention. The primary components of each spray nozzle assembly 44 include a nozzle holder 46 which resides within a nozzle housing 48, and a spray nozzle 50 which is cooperatively engaged to the nozzle holder 46. A more comprehensive discussion of the structural and functional attributes of each spray nozzle assembly 44 integrated into the spray water sub-assembly 38 are found in Applicant's U.S. Pat. No. 6,746,001 (entitled Desuperheater Nozzle), U.S. Pat. No. 7,028,994 (entitled Pressure Blast Pre-Filming Spray Nozzle), U.S. Pat. No. 7,654,509 (entitled Desuperheater Nozzle), U.S. Pat. No. 7,850,149 (entitled Pressure Blast Pre-Filming Spray Nozzle), and U.S. application Ser. No. 13/644,049 (entitled Improved Nozzle Design For High Temperature Attemperators) filed Oct. 3, 2012, the disclosures of which are incorporated herein by reference.

The desuperheater 10 further comprises a steam flow measurement sub-assembly 52. The steam flow measurement sub-assembly 52 comprises a differential pressure transmitter 53 including first and second pressure gauges 54, 56. The first pressure gauge 54 is operatively connected to a first pressure tapping 58 which is disposed within the steam pipe 14 before (i.e., upstream) of the liner 24. As such, the first pressure gauge 54 is in fluid communication with that portion of the interior of the steam pipe 14 which extends between the inlet end 20 and the inlet end 30 of the liner 24. The second pressure gauge 56 is operatively connected to a second pressure tapping 60 which is formed in the liner 24 between the spray nozzle assemblies 44 interfaced thereto and the outlet end 32 thereof, the second pressure gauge 56 thus fluidly communicating with the interior of the liner 24 between the spray nozzle assemblies 44 and the outlet end 32. In accordance with the present invention, the measurement of the differential pressure using measurements taken from the first and second pressure gauges 54, 56 allows for a determination of steam flow through the desuperheater 10.

In addition to the differential pressure transmitter 53 outfitted onto the steam pipe 44 and liner 24 as described above, the steam flow measurement sub-assembly 52 further preferably comprises a pressure transmitter 62 and a temperature transmitter 64 which are each installed in the steam line 22 upstream of the desuperheater 10 for providing a density determination that is also required for the steam flow determination. As indicated above, those of ordinary skill in the art will recognize that the first and second pressure gauges 54, 56 (and corresponding first and second pressure tappings 58, 60) of the steam flow measurement sub-assembly 52 may be provided as original components of the desuperheater 10 operatively interfaced to the steam pipe 14 and liner 24 thereof, or alternatively may be provided as part of a stand-alone steam flow measurement system which is adapted to be retrofitted to an existing desuperheater. As also indicated above, irrespective of whether the first and second pressure gauges 54, 56 and corresponding first and second pressure tappings 58, 60 are provided as original components or are adapted for retrofit application, those of ordinary skill in the art will further recognize that the upstream pressure and temperature transmitter 62, 64 of the steam flow measurement sub-assembly 52 or stand-alone steam flow measurement system will be retrofit to the existing steam line 12 proximate the steam pipe 14 of the desuperheater 10 integrated therein.

The functionality of the steam flow measurement sub-assembly 52 as integrated into the desuperheater 10, wherein steam flow is determined by measuring the differential pressure over the desuperheater 10 using measurements taken from the first and second pressure gauges 54, 56, as well as the upstream pressure and temperature transmitter 62, 64, may be calculated with the following equation:

$$Q = \frac{c}{\sqrt{1-\beta^4}}\varepsilon\frac{\pi}{4}d^2\sqrt{\frac{2\Delta p}{v}}\ [kg/s]$$

The aforementioned equation makes use of the following definitions:

| Symbol | Quantity | Unit |
|---|---|---|
| C | Coefficient of discharge | — |
| d | Diameter in liner | m |
| D | Diameter in steam pipe | m |
| Δp | Differential pressure | Pa |
| β | Diameter ratio = d/D | — |
| ϵ | Expansion factor | — |
| v | Specific volume | $m^3/kg$ |

The differential pressure is the measured pressure based on the measurements taken by the first and second pressure gauges 64, 56. The specific volume is determined by measuring pressure and temperature upstream of the desuperheater 10 using the aforementioned pressure and temperature gauges 62, 64, and then using a steam table to provide the specific volume. All other data is depending on the specific design of the desuperheater 10. Along these lines, data for differing designs of the desuperheater 10 is provided by the examples set forth below.

Example 1

17 Bar Implementation d=0.1433 m

D=0.1747 m

β=0.820

C=0.9947

ϵ=1 (Pressure drop is very small and expansion impact can be neglected.

The equation with inserted values:

$$Q = 0.030667\sqrt{\frac{\Delta p}{v}}\ [kg/s]$$

Calculation Example

P1=18.0 bar a=$18.0\cdot10^5$ Pa

T1=470° C.

Gives v=0.18735 $m^3/kg$

Measured Δp=0.25 bar=25000 Pa

Steam flow Q=0.030667·√(25000/0.18735)=11.202 kg/s=40328 kg/h

Example 2

12 Bar Implementation d=0.1961 m

D=0.248 m

β=0.791

C=0.9947

ϵ=1 (Pressure drop is very small and expansion impact can be neglected.

The equation with inserted values:

$$Q = 0.05444\sqrt{\frac{\Delta p}{v}}\ [kg/s]$$

Calculation Example

P1=13.0 bar a=$13.0\cdot10^5$ Pa

T1=380

Gives v=0.22733 $m^3/kg$

Measured Δp=0.31 bar=31000 Pa

Steam flow Q=0.05444·√(31000/0.22733)=20.103 kg/s=72372 kg/h

Example 3

7.5 Bar Implementation d=0.534 m

D=0.578 m

β=0.924

C=0.9947

ϵ=1 (Pressure drop is very small and expansion impact can be neglected.

The equation with inserted values:

$$Q = 0.604682\sqrt{\frac{\Delta p}{v}}\ [kg/s]$$

Calculation Example

P1=8.5 bar a=$8.5\cdot10^5$ Pa

T1=260° C.

Gives v=0.28137 $m^3/kg$

Measured $\Delta p$=0.026 bar=2600 Pa

Steam flow Q=0.604682·√(2600/0.28137)=12 kg/s=209256 kg/h

Example 4

7.5 Bar Implementation d=0.686 m

D=0.88.2 m $\beta$=0.778

C=0.9947

$\epsilon$=1 (Pressure drop is very small and expansion impact can be neglected.

The equation with inserted values:

$$Q = 0.652955\sqrt{\frac{\Delta p}{v}}\ [kg/s]$$

Calculation Example

P1=4.0 bar a=4.0·$10^5$ Pa

T1=165° C.

Gives v=0.49016 $m^3$/kg

Measured $\Delta p$=0.037 bar=3700 Pa

Steam flow Q=0.652955·√(3700/0.49016)=55.730 kg/s=204229 kg/h

Further in accordance with the present invention, it is generally accepted that the creation of a region of increased steam velocity where the cooling water is injected in a desuperheater helps to establish more robust contact between the steam and the cooling water, improving the efficiency of the desuperheating process. In the desuperheater 10, the selective manipulation of the size or inner diameter of the liner 24 may be used to facilitate the creation of a venturi-like increase in steam velocity as may be used to optimize the performance of the desuperheater 10. Along these lines, it is contemplated that the steam flow measurement sub-assembly 52 of the desuperheater 10 may further be effectively used as a modality in determining an optimal inner diameter dimension for the liner 24.

By way of example, if the inner diameter of the steam pipe of the desuperheater 10 is about 304.7 mm and the desuperheater 10 is outfitted with a liner 24 having an inner diameter of about 206.4 mm, a steam velocity of about 39.91 m/s entering the liner 24 will be increased to about 85.99 m/s through the liner 24. At the same, the pressure drop over the desuperheater 10 as determined by the steam flow measurement sub-assembly 52 would be about 0.1413 bar. However, a reduction in the inner diameter of the liner 24 to about 183.9 mm would facilitate an increase in the steam velocity through the liner 24 from the same initial entry level of about 39.91 m/s to about 109.6 m/s, with the measured pressure drop over the desuperheater 10 as determined by the steam flow measurement sub-assembly 52 being doubled from the aforementioned level to about 0.2828 bar. Since evaporation time at a steady state condition is inversely proportional to the relative velocity between the steam in the liner 24 and the water droplets exiting the spray nozzle assemblies 44 of the spray water sub-assembly 38 to the power of four, the evaporation time in using this example can theoretically be decreased by about 62%, as determined by the application of the following equations:

$$\frac{t_2}{t_1} = \frac{c_1^4}{c_2^4}$$

$t$ = evaporation time $c$ = velocity liner $$t_2 = \frac{c_1^4}{c_2^4} \cdot t_1$$

$$t_2 = \frac{85,99^4}{109,6^4} \cdot 1$$

$$t_2 = 0.3789$$

As indicated above, the measurements provided by the steam flow measurement sub-assembly 52 of the desuperheater 10 may be used as a basis for maximizing the operational efficiency of the desuperheater 10 by allowing for a selective adjustment in the inner diameter dimension of the liner 24, i.e., the diameter of the liner conduit defined by the liner 24.

Still further, it is well established that an attemperator such as the desuperheater 10 which is integrated into the steam pipe 14 will create a pressure drop since the components of the desuperheater 10 (or other attemperator) will impart some level of resistance to steam flow through the steam pipe 14. Any flow meter integrated into the steam pipe 14 will also create a pressure drop since it, like the attemperator or desuperheater 10, defines a resistance creating obstacle within the steam flow. Thus, in a steam pipe such as the steam pipe 14 which is outfitted with one attemperator and one flow meter, pressure drops are created in two places, providing a total pressure drop measurement value. It necessarily follows that use of the single attemperator alone without a flow meter (i.e., the elimination of the flow meter) will result in the creation of only a single pressure drop of a prescribed measurement value. By increasing the pressure drop facilitated by the desuperheater 10 through a reduction in the inner diameter of the liner 24 thereof as describe above, a total pressure drop measurement value may be achieved which is commensurate to that which would otherwise result from the aforementioned attemperator/flow meter combination, despite the absence of any flow meter. As indicated above, this provides the advantage of higher relative velocity between the steam in the liner 24 and the water droplets exiting the spray nozzle assemblies 44 of the spray water sub-assembly 38, and thus better secondary atomizing and shorter evaporation time of the water droplets. Further, higher rangeability is provided by achieving the same pressure drop as would otherwise result from an attemperator/flow meter combination using the desuperheater 10 alone.

In sum, use of the available pressure drop as measured by the differential pressure transmitter 53 of the steam flow measurement sub-assembly 52 to facilitate a prescribed reduction in the inner diameter of the liner 24 of the desuperheater 10 so that such pressure drop is commensurate to that which would result from the use a liner 24 of a larger inner diameter in combination with a flow meter has the advantage of achieving better rangeability, shorter evaporation time of the water droplets, and generally better overall performance.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A steam desuperheater for integration into a steam line, the desuperheater comprising:

a steam pipe having an inlet end, an outlet end, and an inner pipe surface defining a pipe conduit for containing a flow of superheated steam;

a liner mounted within the steam pipe and disposed in spaced relation to at least a portion of the inner pipe surface such that an annular gap is formed between the liner and the steam pipe, the liner having an inlet end, an outlet end, and an inner liner surface defining a liner conduit for containing a flow of superheated steam;

a spray water sub-assembly attached to the steam pipe and including at least one spray nozzle assembly which extends into fluid communication with the liner conduit;

a first pressure gauge connected to the steam pipe so as to be in fluid communication with the pipe conduit between the inlet end of the steam pipe and the inlet end of the liner; and a second pressure gauge connected to the steam pipe and the liner so as to be in fluid communication with the liner conduit between the spray nozzle assembly and the outlet end of the liner.

2. The desuperheater of claim 1 further comprising a pressure gauge and a temperature gauge which are each adapted to be fluidly connected to the steam line upstream of any location thereof having the desuperheater integrated therein.

3. The desuperheater of claim 1 wherein the spray water sub-assembly comprises at least two spray nozzle assemblies which fluidly communicate with the liner conduit in generally opposed relation to each other.

4. A method of measuring steam flow through a desuperheater, comprising the steps of:

a.) providing a steam desuperheater comprising:

a steam pipe having an inlet end, an outlet end, and an inner pipe surface defining a pipe conduit for containing a flow of superheated steam;

a liner mounted within the steam pipe and disposed in spaced relation to at least a portion of the inner pipe surface such that an annular gap is formed between the liner and the steam pipe, the liner having an inlet end, an outlet end, and an inner liner surface defining a liner conduit for containing a flow of superheated steam; and a spray water sub-assembly attached to the steam pipe and including at least one spray nozzle assembly which extends into fluid communication with the liner conduit;

b.) taking a first pressure measurement of superheated steam entering the inlet end of the pipe through the use of a first pressure gauge connected to the steam pipe so as to be in fluid communication with the pipe conduit between the inlet end of the steam pipe and the inlet end of the liner;

c.) taking a second pressure measurement of superheated steam within the liner through the use of a second pressure gauge connected to the steam pipe and the liner so as to be in fluid communication with the liner conduit between the spray nozzle assembly and the outlet end of the liner; and d.) measuring a pressure differential over the desuperheater using the first and second pressure measurements.

5. The method of claim 4, further comprising the step of:

e.) taking a pressure measurement and a temperature measurement of superheated steam upstream of the desuperheater.

6. The method of claim 4, further comprising the step of:

e.) selectively increasing or decreasing a cross-sectional dimension of the liner conduit based on the pressure differential measurement in step (d).

7. In a steam desuperheater comprising a steam pipe having an inlet end, an outlet end, and an inner pipe surface defining a pipe conduit for containing a flow of superheated steam, a liner mounted within the steam pipe and having an inlet end, an outlet end, and an inner liner surface defining a liner conduit for containing a flow of superheated steam, and a spray water sub-assembly attached to the steam pipe and including at least one spray nozzle assembly which extends into fluid communication with the liner conduit, the improvement comprising:

a first pressure gauge connected to the steam pipe so as to be in fluid communication with the pipe conduit between the inlet end of the steam pipe and the inlet end of the liner; and a second pressure gauge connected to the steam pipe and the liner so as to be in fluid communication with the liner conduit between the spray nozzle assembly and the outlet end of the liner.

8. The desuperheater of claim 7 wherein the improvement further comprises a pressure gauge and a temperature gauge which are each adapted to be fluidly connected to a steam line upstream of any location thereof having the desuperheater integrated therein.

* * * * *